US007159642B2

(12) United States Patent
Zajber et al.

(10) Patent No.: US 7,159,642 B2
(45) Date of Patent: Jan. 9, 2007

(54) METHOD AND STRAND GUIDE FOR SUPPORTING, GUIDING AND COOLING CASTING STRANDS MADE OF STEEL, ESPECIALLY PRELIMINARY SECTIONS FOR GIRDERS

(75) Inventors: Adolf Gustav Zajber, Langenfeld (DE); Dirk Letzel, Ratingen (DE); Wilfried Milewski, Korschenbroich (DE); Thomas Fest, Duisburg (DE); Heinz-Dietrich Schneider, Duisburg (DE); Lothar Fischer, Kaarst (DE); Herbert Brotzki, Duisburg (DE)

(73) Assignee: SMS Demag, Deutschland (DE)

( * ) Notice: Subject to any disclaimer, the term of this patent is extended or adjusted under 35 U.S.C. 154(b) by 128 days.

(21) Appl. No.: 10/344,208

(22) PCT Filed: Aug. 7, 2001

(86) PCT No.: PCT/EP01/09092

§ 371 (c)(1),
(2), (4) Date: Jul. 28, 2003

(87) PCT Pub. No.: WO02/11923

PCT Pub. Date: Feb. 14, 2002

(65) Prior Publication Data

US 2004/0020632 A1 Feb. 5, 2004

(30) Foreign Application Priority Data

Aug. 10, 2000 (DE) ..... 10039033

(51) Int. Cl.
*B22D 11/124* (2006.01)

(52) U.S. Cl. ..... 164/444; 164/442

(58) Field of Classification Search ..... 164/486, 164/484, 442, 444

See application file for complete search history.

(56) References Cited

U.S. PATENT DOCUMENTS 3,837,392 A * 9/1974 Rossi ..... 164/424
4,476,914 A * 10/1984 Wrossok ..... 164/444

FOREIGN PATENT DOCUMENTS

JP 04200844 * 7/1992 ..... 14/486

OTHER PUBLICATIONS

Michael Cygler et al., "Near Net Shape Casting and Associated Mill Developments", Iron and Iteel Engineer, 1995, No. 1, pp. 32-38.*
Patent Abstract of Japan JP-56 039 158, Apr. 1981.

(Continued)

*Primary Examiner*—Kevin Kerns
*Assistant Examiner*—I.-H. Lin
(74) *Attorney, Agent, or Firm*—Abelman, Frayne & Schwab

(57) ABSTRACT

A method and strand guide for supporting, guiding and cooling casting strands (1) made of steel, especially preliminary sections (2) for girders, which are cooled by injected water (29) and are drawn, serve to prevent cracks, especially surface cracks, from appearing in the microstructure by adapting the cooling conditions of the surface of the strand in the region of the secondary cooling, and serve to prevent undercooling of the strand shell, wherein in order to avoid an undesirable solidification structure on the upper flange edges or in other cross-sectional areas, the cooling and support of the beam blank format are so adapted to the solidification range that cooling and support are provided exclusively where a crater is formed. To this end, the casting strand (1) is cooled, by guiding the temperature in a specific manner in upper supporting segments (5, 6, 7), by means of spray-water jets the width of which at least matches the length of the supporting rollers on longitudinal and transversal sides (13, 14) of the cross section (1*a*) of the casting strand, and is decreasingly supported in an analogous manner with respect to the length of the casting path and the cooling state in core areas (15) of the cross section (1*a*) of the casting strand on the transversal sides (14) of said casting strand cross-section (1*a*) so that cooling occurs exclusively by means of water jets (8) which are oriented towards said core areas (15).

5 Claims, 5 Drawing Sheets

OTHER PUBLICATIONS

Patent Abstract of Japan JP-04 200844, Jul. 1992.
Patent Abstract of Japan JP-09 174210, Jul. 1997.
Michael Cygler et al. Near Net Shape Casting and Associated Mill Developments, Iran & Steel Engineer, 1995, No. 1, pp. 32-38.
J-M Dengler et al. "Das Gissen Von Beam Blanks in Electrical Steelmaking Plant . . . ", Stahl & Eisen, 199, pp. 89-93.

* cited by examiner 1a
2

1
22
R3
9
R2
R1
101,0mm
93,5mm
85,4mm
76,4mm
66,1mm
54,0mm
38,2mm
7
14m
12m
10m
8m
6m
4m
2m
0m
L
6
12
5
4
3

METHOD AND STRAND GUIDE FOR SUPPORTING, GUIDING AND COOLING CASTING STRANDS MADE OF STEEL, ESPECIALLY PRELIMINARY SECTIONS FOR GIRDERS

CROSS-REFERENCE TO RELATED APPLICATION

This application is a 371 of PCT/EP01/09092, filed Aug. 7, 2001.

BACKGROUND OF THE INVENTION

1. Field of the Invention

The invention relates to a method of and a strand guide for supporting, guiding and cooling of cast strand made of steel, in particular, beam-blank preliminary sections for girders, wherein the cast strand, after leaving a continuous casting mold, is cooled by a secondary cooling in a nil segment and is further cooled in the following support segments by spray water and is drawn out.

2. Description of the Prior Art

JP 42 00 844 discloses providing, in a strand guide, separate support rollers for longitudinal sides of the cast strand cross-section, in form of "jog" rollers and long rollers having a reduced length and arranged in the profile base. On the cast strand side, support rollers having a corresponding length are arranged. This arrangement does not take into account the strand shell thicknesses associated with the points on cast strand and the necessary cooling.

It is to be noted that the functions of the strand guide include not only providing a support for the cast strand against the ferrostatic pressure but also removal of the heat of solidification by secondary cooling and retaining of the profile geometry produced in a continuous casting mold. However, always, surface cracks are formed.

The object of the strand guidance should be obtaining of error-free surface quality of a cast strand, inner quality without cracks and segregations, with maintaining of exact profile.

The object of the invention is to prevent cracks in the microstructure, in particular cracks caused by cooling, by adapting cooling conditions of the strand surface to the secondary cooling, in particular, by preventing undercooling.

SUMMARY OF THE INVENTION

With the use of the method according to the preamble of claim 1, this object is achieved, according to the invention, by adapting the cooling and support of the beam blank format to the solidification range so that, in order to avoid an undesirable solidification structure on the upper flange edges or in other cross-sectional areas, the cooling and support are provided only in areas where a crater is formed.

According to one embodiment of the invention, the cast strand is cooled, by guiding the temperature in a predetermined manner in upper support segments, with spray water jets a width of which corresponds to a length of support rollers on longitudinal and transverse sides of the cast strand cross-section, is decreasingly supported on its transverse sides, in analogous manner with respect to a strand course length and a cooling state in core areas of the cast strand cross-section, and is further cooled with spray water jets directed only onto liquid core areas and having a width equal to or smaller than a width of a crater side. Thereby, undercooling of the strand shell is prevented, and the chance of appearance of cracks, in particular surface cracks, is substantially reduced.

According to a further embodiment of the invention, the cast strand is supported, by guiding the temperature in a predetermined manner, in the nil-segment, on profile ends, in the middle region of the longitudinal sides, and on its transverse sides, so that its longitudinal and transverse sides, except the profile corner regions, are cooled, and with progressive formation of a strand shell along the strand course, only middle regions and the two transverse sides of the strand cross-section are supported and in a region of lowest points of craters of core areas, the transverse sides are decreasingly supported and cooled, and on the longitudinal sides, there are provided spray water jets directed only onto crater areas. Thereby, a predetermined temperature guidance can be achieved dependent on cross-sectional areas of the cast strand cross-section not only for rectangular cast strand cross-sections but also for profile strands.

Other features of the invention include supporting the cast strand cross-section in a region of a crater area, on its transverse sides, without the spray water cooling. Advantageously, with this feature, the heat flow from hot areas to the already cooled areas takes place without a large temperature gradient The predetermined temperature guidance is further achieved by guiding the cast strand, in condition of its most possible solidification, on a support rollers, without the spray water jets and without upper and side support.

The object of the invention is further achieved, with the use of cooling and support means, by subjecting the cast strand to a predetermined temperature guidance in separate support segments so that from a support segment to a support segment, a secondary cooling, which is adapted to a solidification state of the strand profile, is provided, with the support segments which follow the nil support segment being so formed that excessive spray water outflows in a plurality of directions from the cast strand cross-section.

Thereby, by using an appropriate secondary cooling as a result of a predetermined formation of support segments with an optimal arrangement of strand guiding rollers, the tendency of undercooling of strand corners (flange corners) with a poor ductile behavior is avoided, and the formation of cracks in the microstructure and on the surface is prevented. Also, a homogenous temperature distribution in the cast strand cross-section is achieved.

With the temperature guided cooling and support according to the invention, the following advantages are achieved:

- minimized spray water quantity for removal of the heat of solidification,
- reduction of consumption of the running water as a result of elimination of undercooling of flange upper sides and other cross-sectional areas,
- homogenous temperature distribution in a beam-blank cross-section,
- temperature guidance from the mold up to the straightening region,
- adjustment of surface temperatures in favorable ductile region.

The strand guide segment should meet the requirements of technological aspects of their manufacturing. Therefore, they are formed as follows:

- With support rollers which provide support only in a crater area,
- With flange surfaces not being covered in the segments,
- With insurance of optimal outflow characteristics of water, With water collectors and guide plates on segment upper sides so that the smallest possible amount of the running water is consumed.

The support and secondary cooling in accordance with further features are so effected that in the nil support segment, longitudinal sides of the cast strand cross-section are supported by centrally symmetrically arranged paired long support rollers, corner regions of the cast strand profile are supported by pairs of "jog" rollers, having a smaller length, and transverse sides of the cast strand cross-section are supported by support roller pairs a length of which somewhat corresponds to the transverse side length.

Such a support is particularly favorable, e.g., at strand shell thicknesses between 30 and 50 mm. The support is effected practically from all sides only in the crater area in order to prevent the undesirable undercooling.

According to a further embodiment, in the following support segments, on the longitudinal sides of the cast strand cross-section, only centrally arranged long support roller pairs are provided, and on its transverse sides, there is provided a pair of support rollers, a length of which somewhat corresponds to a side length. With this support, the strand shell thicknesses already between 40 and 60 mm can be handled, and the corner areas of the cast strand cross-section need not be supported any more.

A further avoidance of support forces is achieved in accordance with further features, by shortening, in the following support segments, rollers of the support roller pairs, respectively, which are arranged on the transverse sides. This assumes that the central areas of the cast strand have already solidified, and the strand shell has, in the outer regions, a thickness of about from 50 to 70 mm.

With a further progressive solidification, it is contemplated that in the following support segments, the pairs of symmetrical, shortened, support rollers are provided only on the transverse sides. In a cast strand of the preliminary section, according to the invention, in the corner areas of the cast strand cross-section, already a strand shell thickness from 70 to 90 mm has been provided.

It is further contemplated that the cast strand is supported, in sections having a most possible core solidification, only by support rollers provided on its lower side.

A further improvement is achieved by effecting spraying during the secondary cooling analogous to a cast crater in a core area. This prevents a too high water impact.

Advantageously, the excess spray water is carried away. Thereby, only a minimal amount of water remains in the center of a cast strand, e.g. on the profile web of a preliminary section after the strand is not any more supported.

According to a further development of the present invention the spray water jets have a width equal to or wider than the length of associated support rollers. This feature can be used in particular for relatively thin strand shells of about from 30 mm to 60 mm.

Finally, the "jog" rollers can be provided only in the support segment following the nil support segment.

BRIEF DESCRIPTION OF THE DRAWINGS

The drawings show embodiments of the invention which would be described in detail below.

It is shown in.

DETAILED DESCRIPTION OF THE PREFERRED EMBODIMENT

Figures 1, 1A:
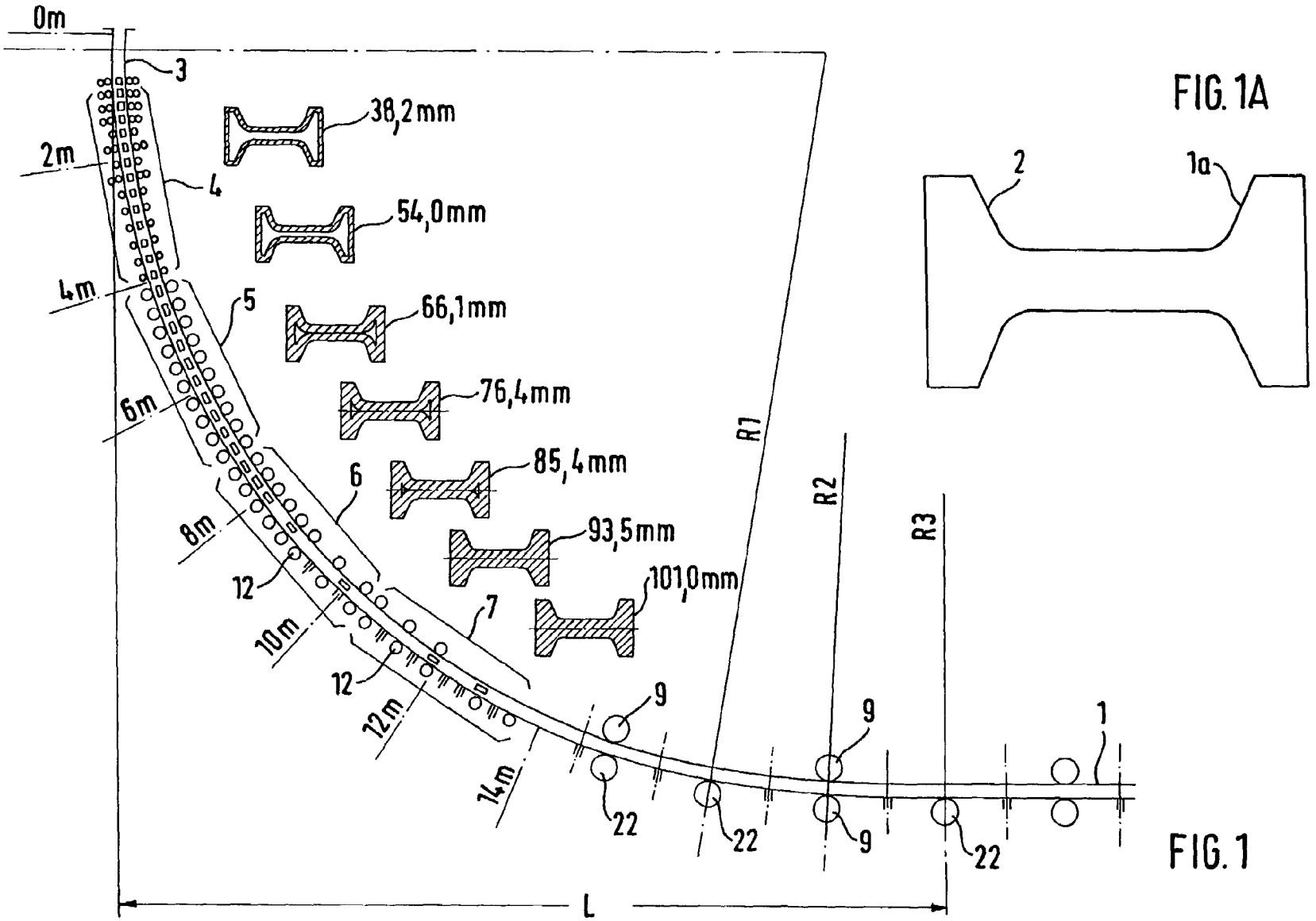
FIG. 1 a side view of a cast strand with strand shell thicknesses associated with a cast strand path for a preliminary section.
FIG. 1A a cast strand cross-section in a continuous casting mold.

FIGS. 1 and 1A show an example of a cast strand 1 for a preliminary section 2 for a to-be-rolled girder. The cast strand 1, after leaving the continuous cast mold 3, is cooled in a nil support segment 4 as a result of secondary cooling, is then cooled, in further support segments 5, 6,7, with water jets 8, and is drawn out by driven rolls of a drawing machine 9.

The thickness data of the thicknesses of the strand shell are given with spacing of 2 m. The length L designates the entire length of the plant from the continuous casting mold 3 to the drawing machine 9. In addition, the radii R1, R2 and R3 of the arches of the strand course are set.

The cast strand 1 is subjected in the (upper) nil support segment 4, by guiding the temperature n a predetermined manner, to action of the spray water jets 8 having a width 10 equal to or greater than the length 11 of a pair of support rollers 12. The spray water jets 8 are provided on both the longitudinal side 13 and the transverse side 14 of the cast strand cross-section 1A (FIGS. 2A–2H). The transverse sides 14 are decreasingly supported (FIGS. 2D–2F) in an analogous manner with respect to the strand course length and the cooling state in core areas 15, which still contain viscous melt in the cast strand cross-section 1*a*, with the spray water jets being directed only onto the core areas (FIG. 2D).

In accordance with the best possible process (FIGS. 2A–2H), the exact cast strand 1, which was produced in the continuous casting mold 3, enters the nil support segment 3 (FIG. 2B) in which the cast strand 1 is supported on its longitudinal side 13 by support rollers 17 arranged in the middle regions 16 of its longitudinal sides, and is supported on the transverse sides 14 by support rollers 18. At that, the profile corner regions 19 of the cast strand 1 are not cooled but are supported by "jog" rollers 20. The spray water jets 8 form, with respect to the strand, which is still in a liquid or viscous condition, and its strand width or strand thickness, an angle opening in the flow direction. Thereby, only there a large amount of heat is removed where the still fluid or viscous melt is present inside the cast strand 1, whereas the already solidified regions of the remaining strand shell 21 are spared. As a result, a gentle cooling of the strand corners takes place, and no surface cracks or few cracks are formed. In accordance with FIG. 2C, the spray water jets 8 are still retained with a wide angle. In FIG. 2D, one immediately sees that only the middle region 16 of the cast strand cross-section 1*a* is supported by the support rollers 17, but it is not cooled any more. The spray water jets 8 are directed only to the core areas 15. The support rollers 18 are shorter. This purposeful temperature guidance continues in the strand course (FIG. 2E) until the spray water jets 8 are directed only onto the core areas 15 in the longitudinal side 13. Finally, the core areas 15 (FIG. 2F) becomes very small, and the cast strand 1 needs not to be cooled any more and is guided only by the support rollers 18 on the transverse sides 14. In FIG. 2G, the core areas 15 are further reduced and the cast strand 1 is guided only by horizontal support roller 22. In FIG. 2H, the cast strand 1 is solidified. The thickness of the strand shell 21 is, e.g., (dependent from respective sizes of the cast strand cross-sections) 38.2 mm in FIG. 2B, 54 mm in FIG. 2C, 66.1 mm FIG. 2D, 76.4 mm in FIG. 2E, 85.4 mm in FIG. 2F, 93.5 mm in FIG. 2G, and 101 mm in FIG. 2H.

FIG. 2 shows one of the support segments 5,6,7. The essential components are an upper frame 23, a lower frame 24, side frames 25, rollers 26, and spray bars 27.

Figure 4A:
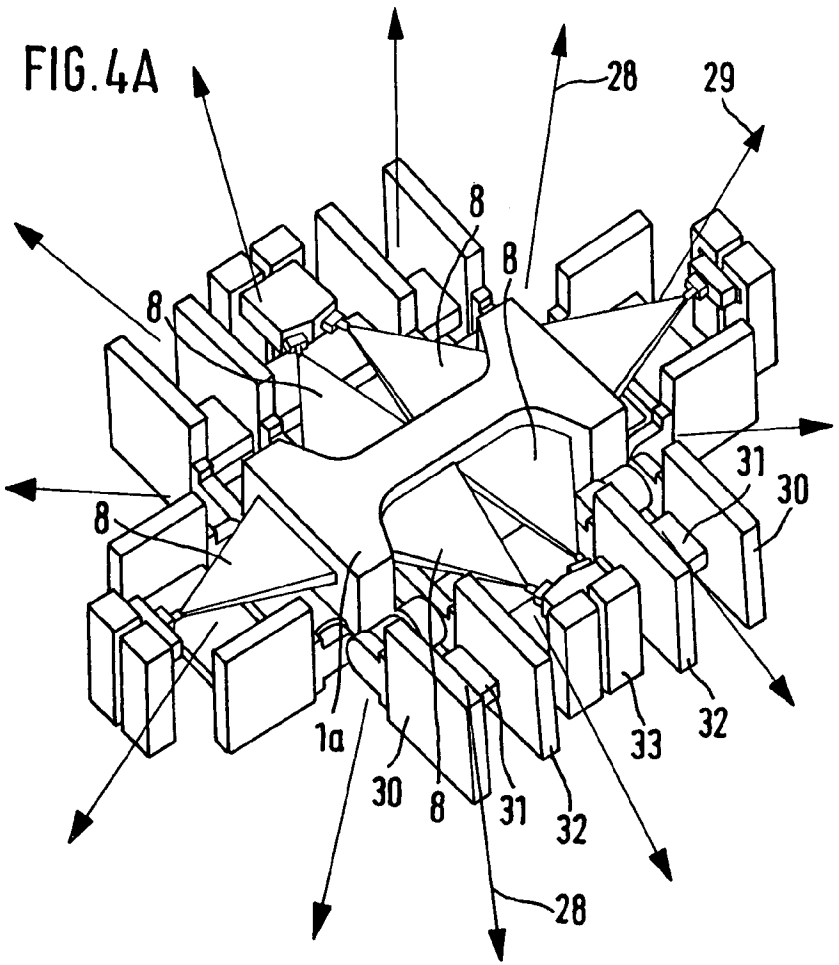
FIG. 4A a perspective view across a support segment with "jog" rollers.
Figure 4B:
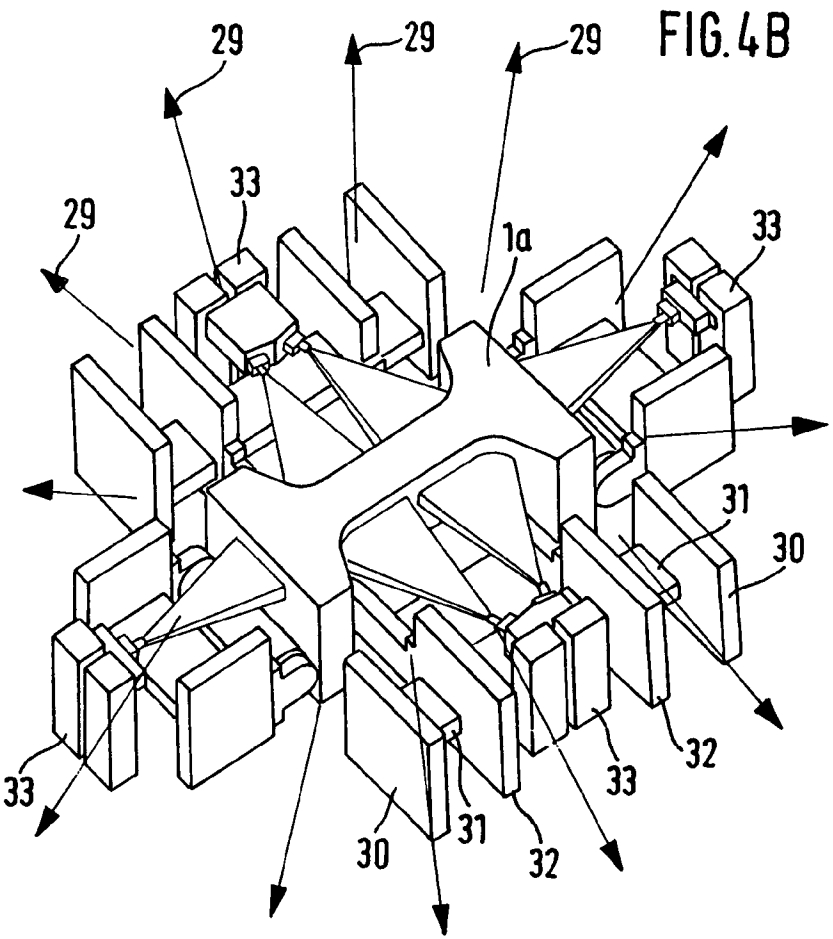
FIG. 4B a perspective view across a support segment without "jog" rollers.

FIGS. 4A and 4B show outflow of the spray water 29 in the direction of arrows 28. The outflow becomes possible in particular by the open profile of the support segments 5, 6, 7, with the cast strand cross-section 1*a* being surrounded, toward an open frame, on its four sides, by outer ribs 30, reinforcing members 31, inner ribs 32, and respective nozzle connections 33.

Figure 2A:
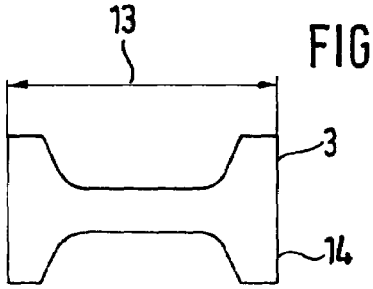
FIG. 2A a cast strand cross-section at the outlet of the continuous casting mold.
Figure 2E:
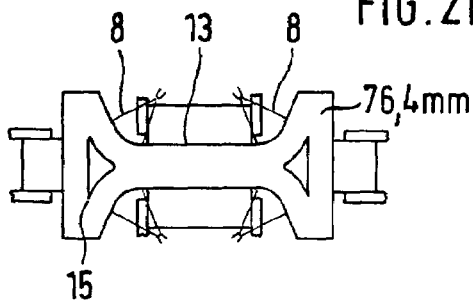
FIG. 2E a cast strand cross-section with an arrangement of support rollers and secondary cooling in a still further support segment.
Figure 2B:
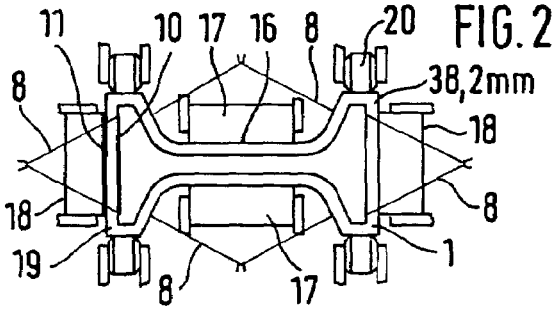
FIG. 2B a cast strand cross-section with an arrangement of support rollers and secondary cooling in nil-segment.
Figure 2F:
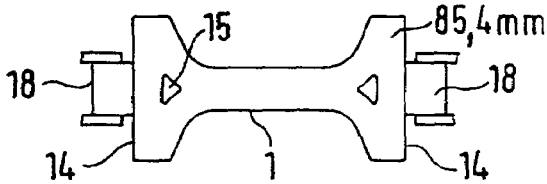
FIG. 2F a cast strand cross-section before solidification without secondary cooling.
Figure 2C:
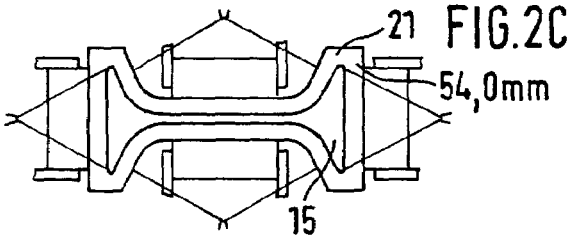
FIG. 2C a cast strand cross-section with an arrangement of support rollers and secondary cooling in a following support segment.
Figure 2G:
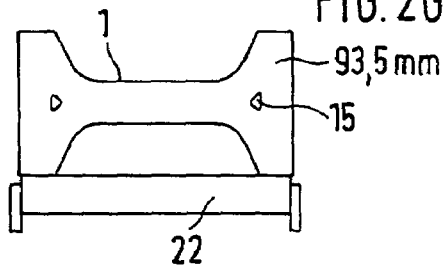
FIG. 2G a cast strand cross-section at almost complete solidification.
Figure 2D:
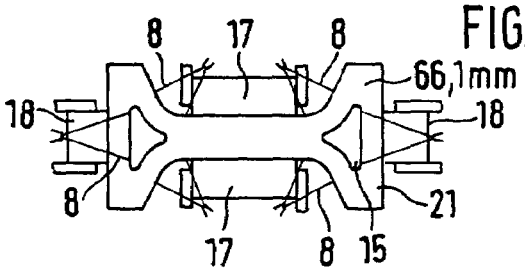
FIG. 2D a cast strand cross-section with an arrangement of support rollers and secondary cooling in a further support segment.
Figure 2H:
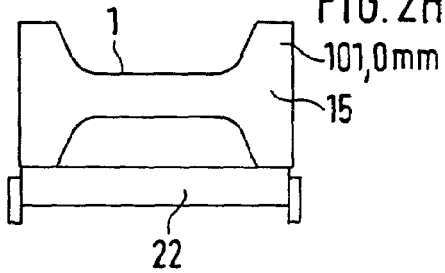
FIG. 2H a cast strand cross-section after complete solidification and supported on a roller table.

The view in FIG. 4A corresponds somewhat to the strand course in FIGS. 2B and 2C. The view in FIG. 4B corresponds to the strand course in FIG. 2D.

Figure 5:
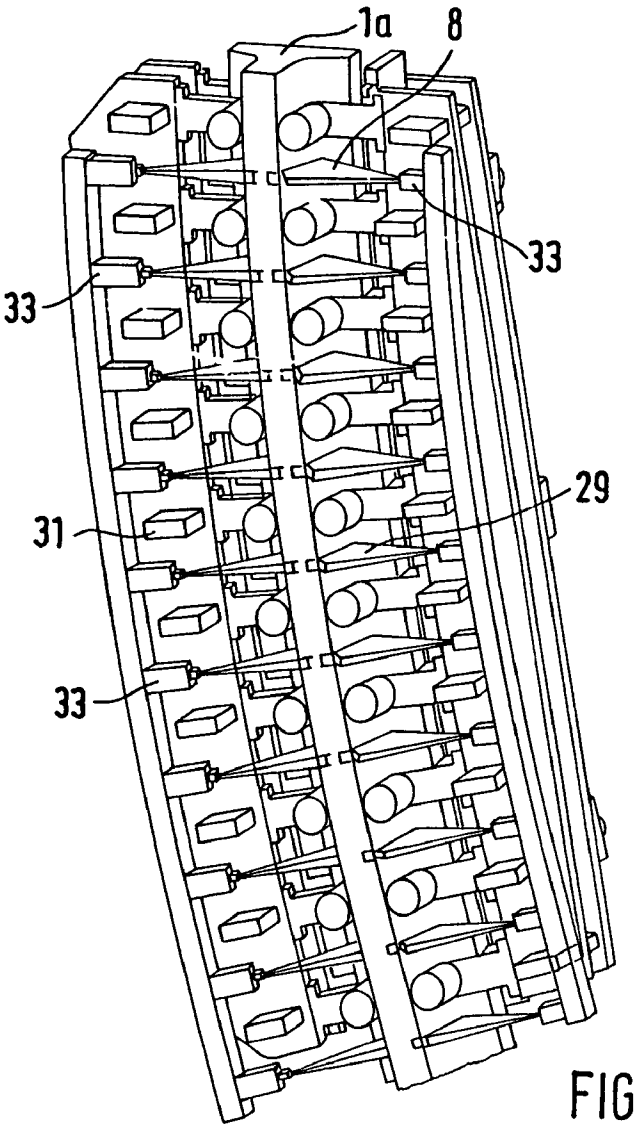
FIG. 5 a perspective side view across the nil support segment in an open design.

FIG. 5 shows a transverse section of the segment 5, 6, 7 shown in its operational position, in which an open shape of the support segment 5, 6, 7 can be clearly seen. The spray water 29, which is injected through the nozzle connections 33 in form of the spray water jets onto the cast strand cross-section 1*a*, can easily circularly flow away between the reinforcing members 31.

Figure 3:
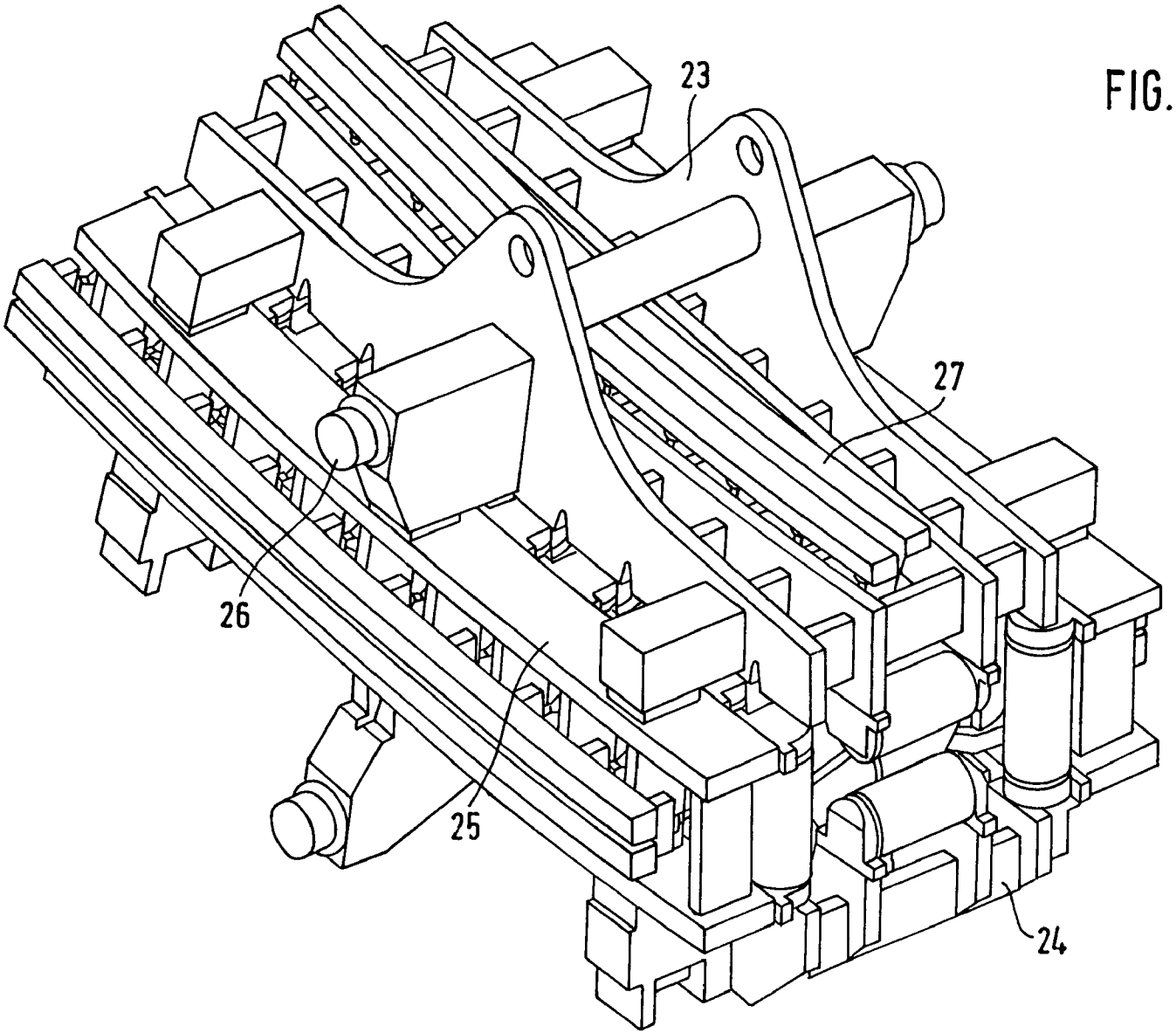
FIG. 3 a perspective view of a support segment.
Figure 6:
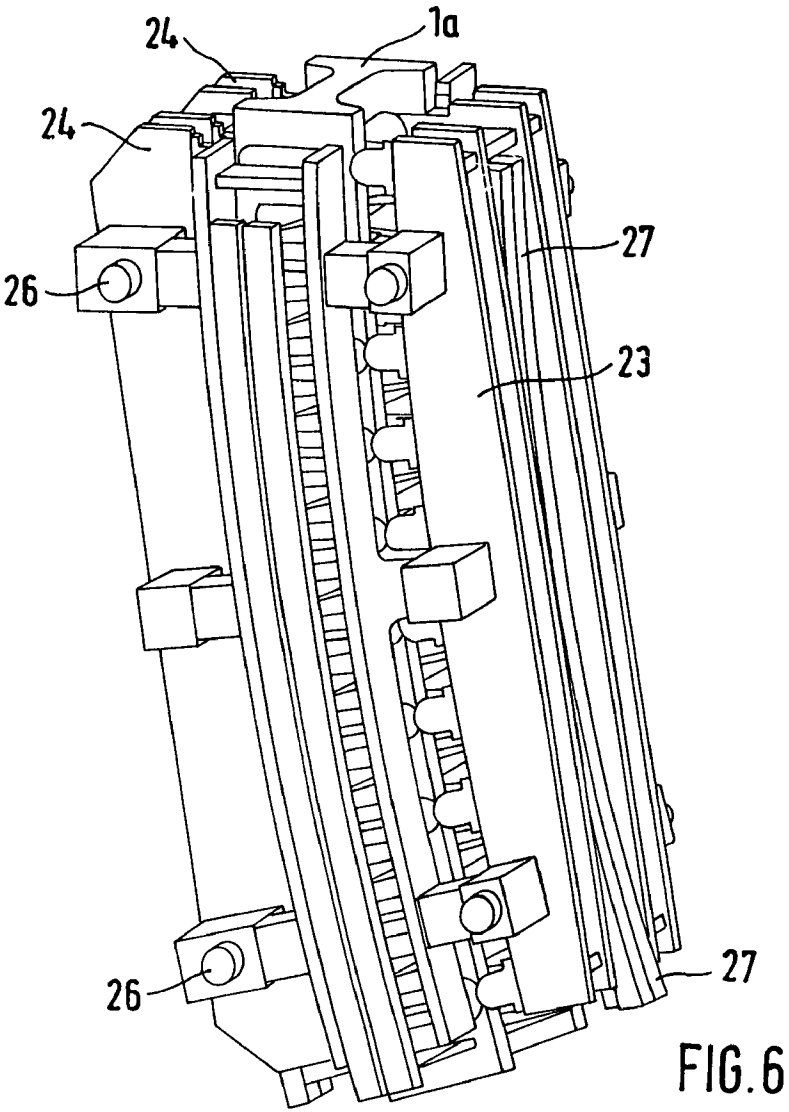
FIG. 6 a perspective view of a nil support segment in an open design.

FIG. 6 shows a support roller strand 5, 6, 7 described with reference to FIG. 3, in its operational position.

LIST OF REFERENCE SIGNS

1. Cast strand.
1*a*. Cast strand cross-section.
2. Preliminary profile (strand profile).
3. Continuous casting mold.
4. Nil support segment.
5. Support segment.
6. Support segment.
7. Support segment.
8. Spray water jet.
9. Drawing machine.
10. Width (of the spray water jet).
11. Length.
12. Pair of support rollers.
13. Longitudinal side (of the cast strand).
14. Transverse side (of the cast strand).
15. Core area.
16. Middle region of the longitudinal sides.
17. Support roller.
18. Support roller.
19. Profile corner region of the cast strand.
20. "Jog" roller.
21. Strand shell.
22. Horizontal support roller.
23. Upper frame
24. Lower frame.
25. Side frame
26. Displacement roller.
27. Spray bar
28. Arrow direction.
29. Spray water.
30. Outer rib
31. Reinforcing member
32. Inner rib.
33. Nozzle connection.

The invention claimed is:

1. A strand guide for a steel cast strand, comprising a nil support segment adjoining a continuous casting mold; a plurality of further, following each other, support segments dimensions of support means of which are reduced in accordance with solidification state of the cast strand as it is displaced along the strand guide so that it is supported only in an area of a liquid phase; means for cooling the cast strand only in the area of liquid phase and comprising water jets means; and drawing means, wherein the water jets means is so arranged in the nil support segment that water jets completely impact longitudinal sides of a middle region of the cast strand, and is arranged in the further support segments so that water jets impact only corner regions of the longitudinal sides of the middle region of the cast strand, and wherein the water jet means is so arranged on transverse sides of the cast strand that water jets have a width corresponding to a length of support means of respective support segments on the transverse sides of the cast strand, with the length of respective support means of the respective support segments corresponding to a liquid phase formation.

2. A strand guide according to claim 1, wherein the support means of the support segments is formed as support roller pairs.

3. A strand guide according to claim 2, wherein the nil support segment comprises a centrally symmetrically arranged, long support roller pair for supporting the longitudinal sides of the cast strand, jog rollers for supporting corner regions of a profile of the cast strand and having a length approximately corresponding to a length of a transverse side of the cast strand.

4. A strand guide according to claim 1, further comprising support segments each of which comprises only support rollers for supporting the transverse sides of the cast strand.

5. A strand guide according to claim 3, further comprising support segments each of which comprises only long support roller means for supporting a lower side of the cast strand.

* * * * *